US007177133B2

(12) United States Patent
Riskin

(10) Patent No.: US 7,177,133 B2
(45) Date of Patent: Feb. 13, 2007

(54) METHOD AND APPARATUS FOR BIPOLAR ION GENERATION

(75) Inventor: Yefim Riskin, Katzrin (IL)

(73) Assignee: Ionic Systems Ltd., Katzrin (IL)

( * ) Notice: Subject to any disclaimer, the term of this patent is extended or adjusted under 35 U.S.C. 154(b) by 0 days.

(21) Appl. No.: 10/510,099

(22) PCT Filed: Apr. 7, 2003

(86) PCT No.: PCT/IL03/00289

§ 371 (c)(1),
(2), (4) Date: Oct. 5, 2004

(87) PCT Pub. No.: WO03/088440

PCT Pub. Date: Oct. 23, 2003

(65) Prior Publication Data

US 2005/0122658 A1 Jun. 9, 2005

(30) Foreign Application Priority Data

Apr. 9, 2002 (IL) ..... 149059

(51) Int. Cl.
*H01T 23/00* (2006.01)

(52) U.S. Cl. ..... 361/230; 361/231; 361/235

(58) Field of Classification Search ..... 361/230, 361/231, 235
See application file for complete search history.

(56) References Cited

U.S. PATENT DOCUMENTS

| | | | | |
|---|---|---|---|---|
| 4,740,862 | A * | 4/1988 | Halleck | 361/231 |
| 4,757,422 | A | 7/1988 | Bossard et al. | |
| 5,057,966 | A * | 10/1991 | Sakata et al. | 361/213 |
| 5,153,811 | A | 10/1992 | Rodrigo et al. | |
| 5,432,454 | A * | 7/1995 | Durkin | 324/452 |
| 6,002,573 | A * | 12/1999 | Partridge | 361/231 |
| 6,259,591 | B1 * | 7/2001 | Pitel et al. | 361/212 |
| 6,373,680 | B1 | 4/2002 | Riskin | |
| 6,850,403 | B1 * | 2/2005 | Gefter et al. | 361/230 |

FOREIGN PATENT DOCUMENTS

IL 119613 11/1996

* cited by examiner

*Primary Examiner*—Brian Sircus
*Assistant Examiner*—Z Kitov
(74) *Attorney, Agent, or Firm*—Pearl Cohen Zedek Latzer, LLP

(57) ABSTRACT

A method and apparatus for generating positive and negative ions, the method comprising: generating ac high voltage; providing different polarity of the high-voltage to at least one pair of ionizing electrodes mounted in separate conducting cages located adjacent to each other, each of the cages provided with an opening opposite the electrode; balancing ion currents emitted by each of the electrodes by providing a balancing unit, output from the ac high voltage being via the balancing unit to the electrodes, each electrode provided with different polarity; and generating an external electric field by using the ion current from each electrode across to the cage in which the electrode is mounted, passing through an element for producing a voltage drop, whereby some of the ions generated from the electrodes escape outside the cages due to the presence of electric field between the cages.

7 Claims, 3 Drawing Sheets

METHOD AND APPARATUS FOR BIPOLAR ION GENERATION

CROSS-REFERENCE TO RELATED APPLICATIONS

This application is a National Phase Application of PCT International Application No. PCT/IL03/00289, international Filing Date Apr. 7, 2003, claiming priority of Israel Patent Application 149059, filed Apr. 9, 2002.

The method and apparatus of the present invention (namely ion generation and ion generator) relate to methods and generators using a single source of high ac voltage and at least two air-ionizing electrodes for ion generation, that can be used for bipolar air ionization, as well as in devices designated for eliminating static electricity.

BACKGROUND OF THE INVENTION

All know ion generators have at least one screen positioned in front of the air ionizing electrodes. Normally it is a conducting screen, however at times device body elements, which are not necessarily conducting, might be used as a screen.

The screen acts as a passive electrode and it is needed for corona discharge generation between electrodes during which ions are generated.

The screen may have a certain potential or alternatively be grounded.

The Invention disclosed in U.S. Pat. No. 6,373,680 (Riskin) titled METHOD AND DEVICE FOR ION GENERATION exemplifies a device designated only for unipolar ionization, which in fact is one of its main disadvantages.

U.S. Pat. No. 4,740,862 shows in FIG. 1 an ion generator, in which the potential of the screen is close to zero. Ion generators are also known which are provided with two conducting screens mounted one after the other in front of the ionizing electrode (See U.S. Pat. No. 4,757,422 and U.S. Pat. No. 5,153,811).

The first screen in U.S. Pat. No. 4,757,422 has a zero potential and it serves to provide a corona discharge between this screen and the ionizing electrode.

The potential of the second screen in that invention is close to zero and serves as an imbalance sensor.

The first conducting screen in the device depicted in U.S. Pat. No. 5,153,811 FIG. 4 has a certain potential during operation.

The second screen in that invention is grounded.

The principal disadvantage of these and similar ion generators is their short operation life caused by dust precipitation on the ionizing electrodes, which results in gradual decrease of ions emission until its complete cessation.

This is because the electric field capable of accelerating ions is concentrated only between the ionizing electrode and the screen the potential of which is close to zero.

Since there are no construction elements generating electric fields external relatively to the apparatus beyond the screen, that are capable of carrying the ions away from the device, the ions are exported to the environment by an airflow directed through the corona discharge area, namely the area between the ionizing electrodes and the screen.

In virtue of the fact that the corona discharge area is actually an electrostatic filter, dust contained in the airflow precipitates on all the elements forming the corona system, including the ionizing electrode.

Besides, the known inventions do not provide any indication of the reduction or ceasing of ion emission.

One of the objects of the present invention is to generate stationary external electric field assisting to carry the ions away from the generator without allowing airflow to pass through the corona discharge area.

In order to attain the object of the invention, a first ion current is made to flow through the screen holding the electrode, generating positive ions, passes through a voltage stabilizer having a high positive potential in reference to the ground, and a second ion current is made to flow through the screen holding the electrode generating negative ions passes through a voltage stabilizer having high negative potential in reference to the ground, whereas for balancing the output of both ion currents, after passing the screens and voltage stabilizers, the ion currents are passed through capacitive network common for these currents.

Another object of the above invention is to provide self-balance of the positive and the negative output ion currents.

In methods and generators with balanced currents emitted by the ionizing electrode, the above object is attained by merely balancing the ion currents flowing via the screens to the ground.

In the method of the present invention the ion currents flowing via the screen to the ground are controlled by changing the screen potentials relative to the ground.

To do so, the ion currents emitted by each of the screens towards the ground, from separated circuits constituting voltage stabilizers, are passed through a capacitive network common for these currents.

In this case when the screen currents are equal, the voltage drop on the common capacitive network is equal to zero and the screen potentials are determined by their respective voltage stabilizers.

In case of screen currents imbalance, which might stem from an initial difference in the distances from the ends of the ionizing ion electrodes to the screens, bias voltage is generated on the common capacitive network, which acts as negative feedback and redistributes the screen potentials relative to the ground, which results in screen ion current balance, and consequently in self-balance of positive and negative output of ion currents.

At the same time the voltage difference between the screens remains unchanged and equal to the sum of voltage stabilizer voltages, which provides for steady value of the external electric field between the screens.

Even though in this invention the airflow passes beyond the generator borders rather than the corona discharge area, which in itself considerably reduces the electrodes contamination with dust and considerably increases the service life, another object of the invention is to support a constant ions emission level during the operation of the generator.

To attain this object, at least one of the ion currents emitted by the screens, or at least one of the ion currents emitted by the air ionizing electrodes are used as a feedback signal controlling the generator parameters.

In addition to the mentioned objects, one more object of this method is providing an indication of the need to clean the air ionizing electrodes from dust.

In order to attain this object, minimal value of the feedback signal below which the preset level of ion emission is not maintained, is used as an Indicating signal.

The proposed method of the present invention is implemented in ion generator, which has at least two air-ionizing electrodes, insulators with these electrodes mounted in them, conducting screens with electrodes arranged inside them, rectifying high voltage diodes, condenser, balancing ion currents emitted by the electrodes, stabilizers of the positive and negative screen voltage, condenser balancing the ion currents emitted by the screens, generator of high ac voltage, feedback network, comparator and indicator.

BRIEF DESCRIPTION OF THE INVENTION

There is thuas provided, in accordance with a preferred embodiment of the present invention, a method of generating positive and negative ions comprising:

generating ac high voltage;

providing different polarity of the high-voltage to at least one pair of ionizing electrodes mounted in separate conducting cages located adjacent to each other, each of the cages provided with an opening opposite the electrode;

balancing ion currents emmited by each of the electrodes by providing a balancing unit, output from the ac high voltage being via the balancing unit to the electrodes, each electrode provided with different polarity; and generating an external electric field by using the ion current from each electrode across to the cage in which the electrode is mounted, passing through an element for producing a voltage drop, whereby some of the ions generated from the electrodes escape outside the cages due to the presence of electric field between the cages.

Furthermore, in accordance with a preferred embodiment of the present invention, ion currents from both electrodes are passed through capacitive network common for these currents.

Furthermore, in accordance with a preferred embodiment of the present invention, at least one of the ion currents emmited through the cage is used for providing a feedback signal for comparing the feedback signal with a reference signal to control the AC high-voltage generator, for stabilizing ion emmision.

Furthermore, in accordance with a preferred embodiment of the present Invention, the minimal value of the feedback signal, below which a predetermined ion emission level is not supported, is used to indicate the need for cleaning or replacing of the electrodes.

Furthermore, in accordance with a preferred embodiment of the present invention, at least one of the ion currents emmited through an electrode is used for providing a feedback signal for comparing the feedback signal with a reference signal to control the AC high-voltage generator, for stabilizing ion emmision.

Furthermore, in accordance with a preferred embodiment of the present invention, the minimal value of the feedback signal, below which a predetermined ion emission level is not supported, is used to indicate the need for cleaning or replacing of the electrodes.

Furthermore, in accordance with a preferred embodiment of the present invention, there is provided a generator for generating positive and negative ions comprising:

ac high voltage generator;

at least one pair of ionizing electrodes provided with different polarity from the AC high-voltage generator, mounted in separate conducting cages located adjacent to each other, each of the cages provided with an opening opposite the electrode;

a balancing unit for balancing ion currents emmited by each of the electrodes, output from the ac high voltage being via the balancing unit to the electrodes, each electrode provided with different polarity: and an element for producing a voltage drop connected to each of the cages for generating an external electric field by using the ion current from each electrode across to the cage in which the electrode is mounted, passing through the element for producing a voltage drop, whereby some of the ions generated from the electrodes escape outside the cages due to the presence of electric field between the cages.

Furthermore, in accordance with a preferred embodiment of the present invention, the ionizing electrodes are connected to different polarity of the AC high-voltage generator is carried out by two inversely-connected rectifying diodes.

Furthermore, in accordance with a preferred embodiment of the present invention, the element for producing a voltage drop is a Zener diode with a condenser.

Furthermore, in accordance with a preferred embodiment of the present invention, the generaotr is further provided with a comparator for comparing a feedback signal corresponding to the ion current emmited through at least one cage with a reference signal to control the AC high-voltage generator, for stabilizing ion emmision.

Furthermore, in accordance with a preferred embodiment of the present invention, the generator is further provided with a comparator for comparing a feedback signal corresponding to the ion current emmited through at least one electrode with a reference signal to control the AC high-voltage generator, for stabilizing ion emmision.

Furthermore, in accordance with a preferred embodiment of the present invention,the generator is further provided with an indicator for indicating the need for cleaning the electrodes from dust or repair.

DETAILED DESCRIPTION OF THE DRAWINGS

Figure 1:
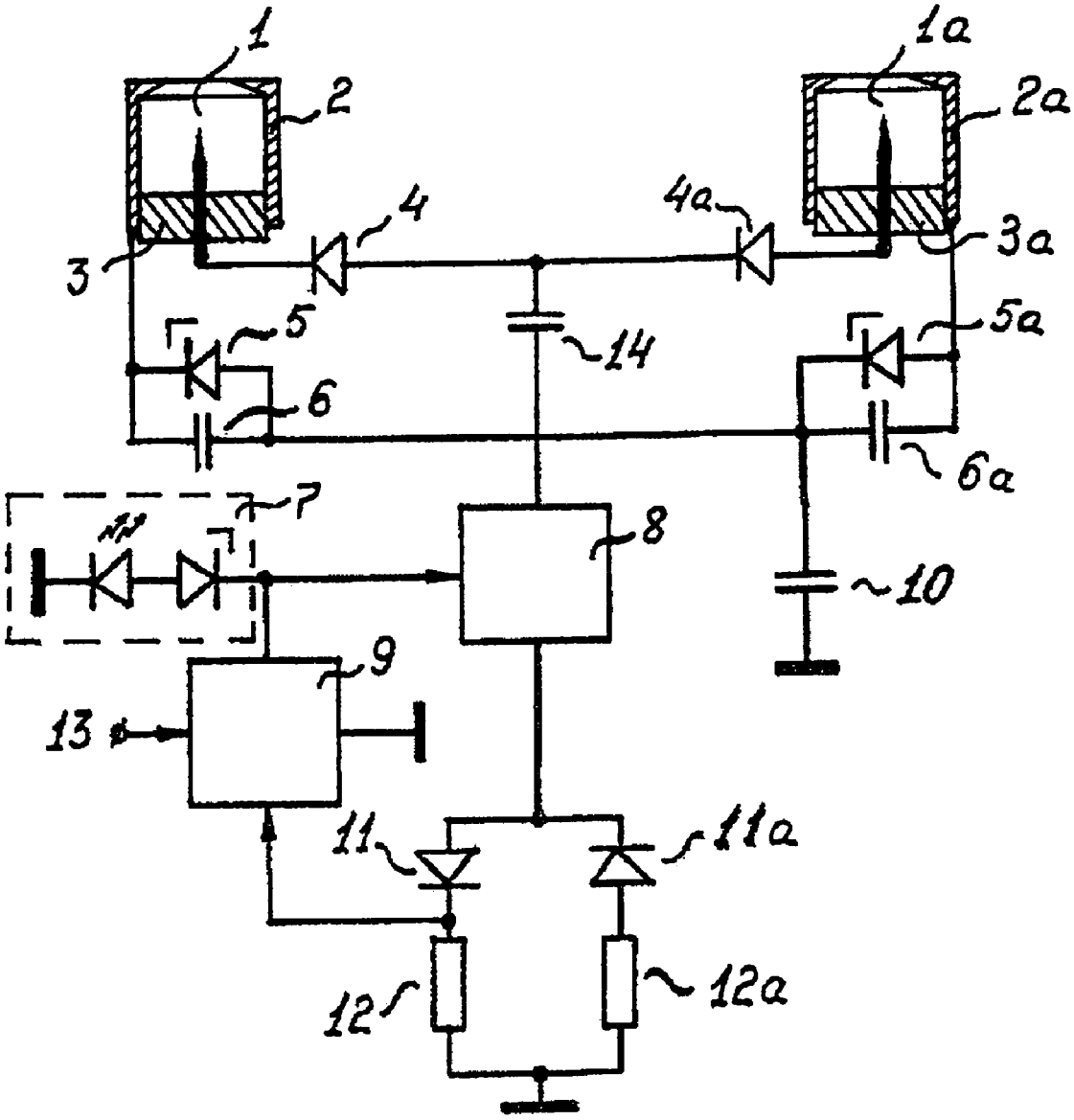
FIG. 1 is an electric diagram and construction of bipolar ion generator containing separate elements for balancing the electrode-emitted and screen-emitted currents in order to balance the positive and negative output ion currents.

Reference is made to FIG. 1. As can be seen from FIG. 1, air ionizing electrodes 1 and 1*a*, mounted in insulators 3 and 3*a*, are connected to one of the terminals of Inversely-connected rectifying high-voltage diodes 4 and 4*a*, while the common connection point of the other terminals of diodes 4 and 4*a* is via balancing condenser 14 connected to high potential terminal of ac voltage generator 8, the low potential terminal of which is connected to the ground via a feedback network consisting of two circuits branches, connected in parallel, each consisting of diode and resistor connected in series (11 & 12 and 11*a* & 12*a* respectively), with diodes 11 and 11*a* in the circuits being inversely-connected relatively to each other.

The common connection point of diode and resistor of at least one of the circuits (for example 11 & 12) is connected to one of the inputs of comparator 9 to the second input of which reference voltages are applied via terminal 13, the comparator 9 output being connected to the control terminal of ac voltage generator 8 and to one of indicator 7 outputs, the other output of which is grounded.

At the same time screens 2 and 2*a* with electrodes 1 and 1*a* mounted in them are connected to high voltage terminals of voltage stabilizers, each consisting of Zener diode 5 and 5*a* and condenser 6 and 6*a* connected in parallel, while the common point of connection of low voltage stabilizer terminals is connected to the ground via condenser 10. For the purpose of the present invention the term "screen" means a cage made of a conductive material where an electrode is mounted within, with one opening opposite the electrode for allowing ions to escape from the cage.

The two screens are mounted in vicinity to each other so that there exists an influencing electric field between them.

The ion generator operation is explained hereinafter, as follows:

Ac voltage generator 8 generates high voltage, which is applied to electrodes 1 and 1*a* via balancing condenser 14 and inversely-connected diodes 4 and 4*a*.

Corona discharge is generated between electrodes 1 and 1*a* and screens 2 and 2*a*, and ion currents emitted by the screens flowing through Zener diodes 5 and 5*a* and condensers 6 and 6*a* generate voltages across screens 2 and 2*a*, the polarity of which corresponds to the polarity of the ions emitted by electrodes 1 and 1*a*, while the voltage between screens 2 and 2*a* corresponds to the sum of stabilization voltages of Zener diodes.

As can be seen from FIG. 1 screens 2 and 2*a* have holes used only for ions removal outside the corona system.

Ions are expelled to the environment by the external electric field generated between screens 2 and 2*a*.

At the same time currents emitted by screens 2 and 2*a* flow also in the common circuit—via condenser 10, which balances these currents.

Taking into consideration that condenser 14 balances the ion currents emitted by electrodes 1 and 1*a*, the balance of ion currents emitted by screens 2 and 2*a* apparently results in automatic balancing of output ion currents at the generator output.

In case of imbalance of ion currents emitted by screens 2 and 2*a* bias voltage is generated across condenser 10, which equalizes the currents emitted by screens 2 and 2*a*.

Voltage across condenser 10 redistributes potentials across screens 2 and 2*a* relatively to the ground, leaving the difference of potentials between the screens unchanged.

In order to preserve constant ionization level during the operation of the generator, feedback network and comparator 9 used for controlling the high ac voltage generator 8 parameters are added to it. Ionization level is maintained unchanged as follows:

Feedback network consisting of two circuits connected in parallel, each consisting of inversely connected diodes 11 and 11*a* and resistors 12 and 12*a* connected to them in series separate the currents of corona electrodes 1 and 1*a* flowing via low potential terminal of ac voltage 8 to positive and negative components.

Owing to the equality of these currents either one or both of them can be used as a feedback signal.

The feedback signal reading point (for example a point of connection of diode 11 and resistor 12) is connected to one of the comparator 9 inputs.

Reference voltage is applied to the other input of comparator 9 via terminal 13, which determines the required ionization level.

Comparator 9 produces a control signal, which is applied from the output of comparator 9 to the control terminal of ac voltage generator 8.

Control signal changes the parameters of generator 8 (frequency of high voltage pulses or their amplitude) in this way maintaining the preset ionization level unchanged throughout the operation of the device.

However, even such stabilization of output ion current is limited by the features of ac voltage generator 8.

In case of heavy contamination or failure of electrodes 1 and 1*a*, low level of feedback signal can serve as an indication of the need for maintenance (cleaning of the electrodes from dust) or repair.

To do so, voltage controlling ac voltage generator 8 operation from the output of comparator 9 is applied also to indicator 7 consisting of a LED and Zener diode, the stabilization voltage of which is selected according to the minimal feedback signal which does not allow to maintain the preset level of ions emission.

Figure 2:
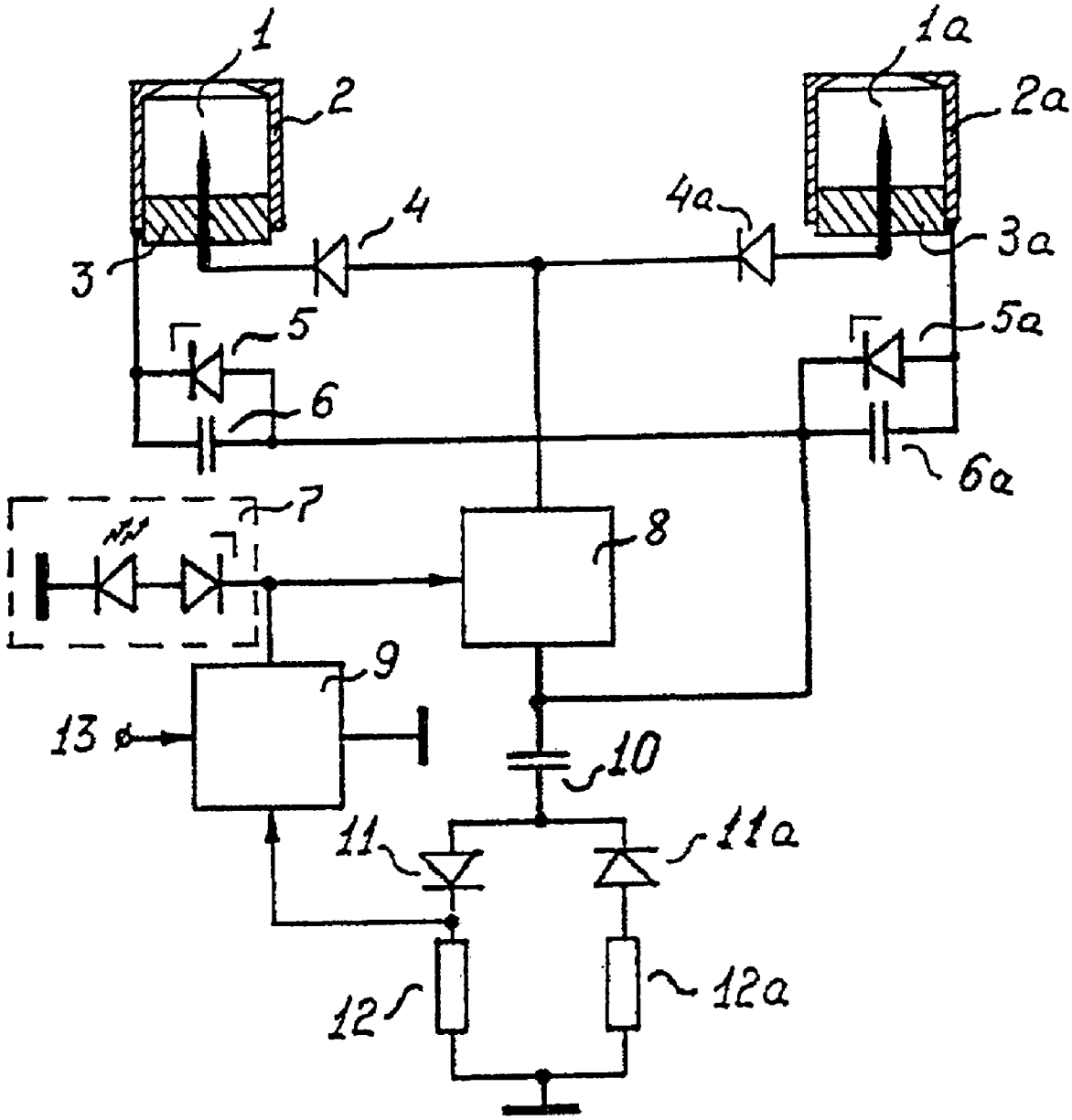
FIG. 2 is an electric network and construction of bipolar ion generator in which a single balancing element is used for balancing the positive and negative output ion currents.

Reference is now made to FIG. 2 showing ion generator embodiment, which includes one element used for direct balancing of the positive and negative output ion currents.

This embodiment does not include condenser 14 previously used for balancing electrodes 1 and 1*a* currents. For general balance condenser 10 is used. The low-potential input of generator 8 is connected to high-potential terminal of condenser 10, whereas the low-voltage terminal of condenser 10 is via feedback network 11, 11*a*, 12, 12*a* connected to the ground.

In this embodiment the operation of the ion generator is as follows: currents emitted by electrodes 1 & 1*a* and screens 2 & 2*a* concurrently flow via condenser 10. However the currents of each electrode and its respective screen have opposite polarity, therefore the voltage drop across condenser 10 determined by the difference between the positive and negative output currents of the generator.

This voltage drop across condenser 10 redistributes the potentials of screens 2 & 2*a* relatively to the ground, which results in balancing of output ion currents as described above.

Figure 3:
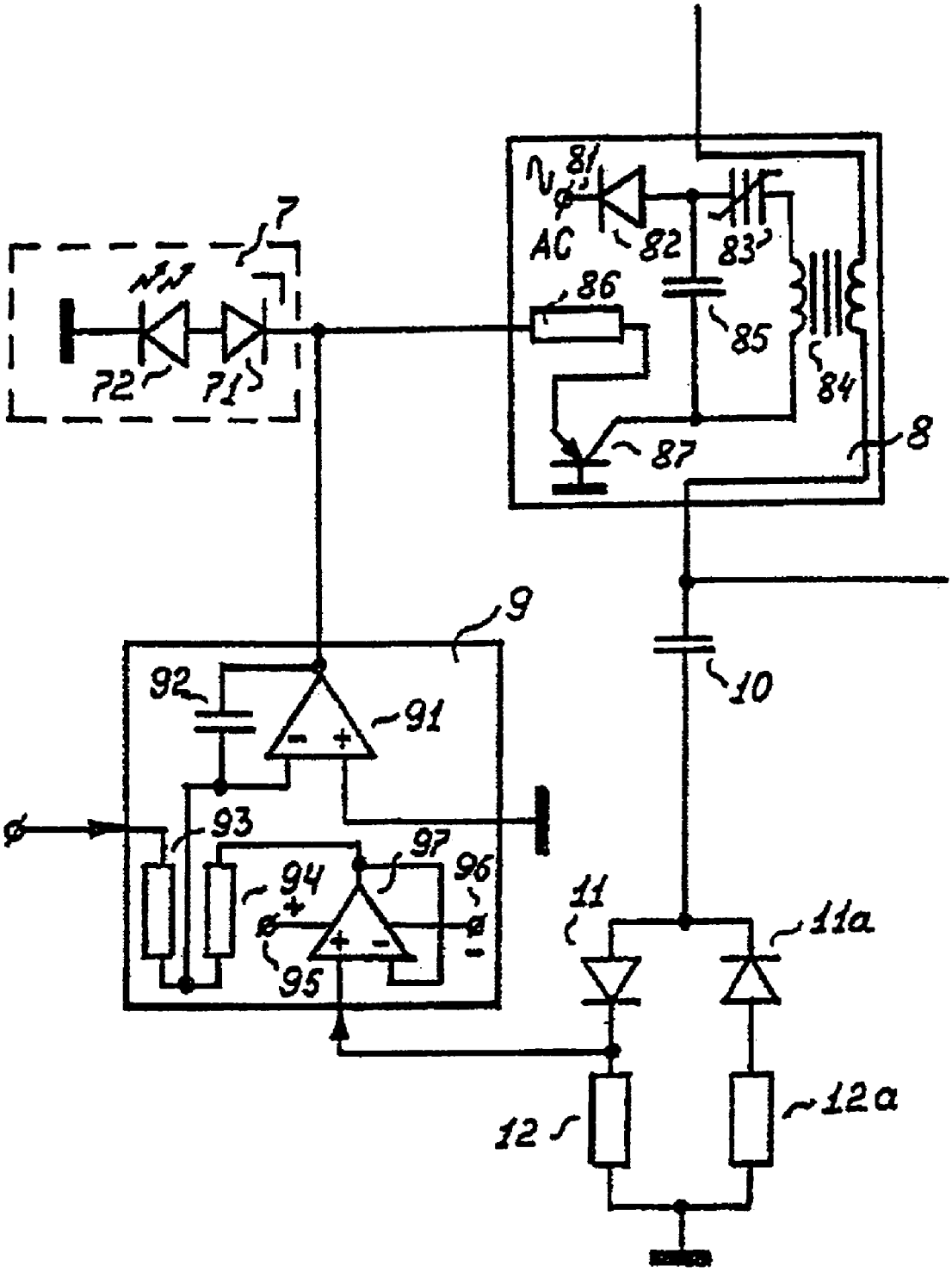
FIG. 3 is an embodiment of a high ac voltage generator, comparator and indicator.

Reference is made to FIG. 3 showing an embodiment of ac voltage generator 8, comparator 9 and indicator 7 in the proposed ions generator.

Comparator 9 consists of two operational amplifiers 91 and 97 powered via terminals 95 and 96. Operational amplifier 97 is used as a noninverting amplifier with amplification coefficient equal to 1 and it is used to obtain high resistance at the comparator input.

Operational amplifier 91 is a comparator used for comparing of two voltages—feedback voltage and reference voltage applied to the inverting input of amplifier 91 via resistors 94 and 93. Integration element—condenser 92 is connected in the feedback circuit of amplifier 91.

Generator of high ac voltage 8 is a standard relaxation generator used for high voltage generating, step-up pulse transformer 84.

Generator 8 is powered from the mains via terminal 81 and the ground.

Generator 8 consists of diode 82, bi-directional thyristor (SADAC) 83, condenser 85, transistor 87 whose collector-base junction is used as an adjustable resistor, as well as resistor 86, via which current is determined to the emitter-base junction of transistor 87 which is determined by the control voltage applied from the output of comparator 9.

Generator 8 relaxation time is determined by condenser 85 charging current, which in turn depends on the control voltage produced by comparator 9.

Generator 8, feedback network 11, 11*a*, 12, 12*a* and comparator 9 constitute a standard current stabilizer in which relaxation frequency is used as an adjustable parameter of ac voltage generator 8.

At the instant the above stabilizer fails to provide preset level of ions emission, meaning that comparator 9 supplies maximal control voltage to generator 8 and the generator operates at a maximal possible relaxation frequency, this very voltage opens Zener diode 71 in indicator 7 and current flow is initiated via diode 72 (LED), which indicated the need in preventive cleaning of electrodes or their repair.

Exemplary parameters of performance in an embodiment of the ion generator of the present invention is given below but does not limit the scope of the present invention to other values of these parameters:

Amplitude of positive and negative pulses—6 kV

Pulse duration—$15 \cdot 10^{-6}$ sec

Initial pulses frequency—20-Hz

Positive and negative ions emission level—$10^{10}$ ion/sec

Balance ±2%

Period of continuous generator operation without a decrease in ions emission—7 months.

The invention claimed is:

1. A method of generating positive and negative ions comprising:

generating AC high voltage;

providing different polarity of the high-voltage to at least one pair of ionizing electrodes mounted in separate conducting cages located adjacent to each other, each of the cages provided with an opening opposite the electrode;

balancing ion currents emitted by each of the electrodes by providing a balancing unit, output from the AC high voltage being provided via the balancing unit to the electrodes, each electrode provided with different polarity; and generating an external electric field by providing electrical potential difference between the cages, wherein the electrical potential difference between the cages, with reference to the ground is provided using the ion current from each electrode across to the cage in which the electrode is mounted, passing through an element for producing a voltage drop, whereby some of the ions generated from the electrodes escape outside the cages due to the presence of external electric field.

2. A generator for generating positive and negative ions comprising:

AC high voltage generator;

at least one pair of ionizing electrodes provided with different polarity from the AC high-voltage generator, mounted in separate conducting cages located adjacent to each other, each of the cages provided with an opening opposite the electrode;

a balancing unit for balancing ion currents emitted by each of the electrodes, output from the AC high voltage being provided via the balancing unit to the electrodes, each electrode provided with different polarity; and an element for producing an electric potential difference between the cages, connected to each of the cages for generating an external electric field by using the ion current from each electrode across to the cage in which the electrode is mounted, passing through the element for producing a voltage drop, whereby some of the ions generated from the electrodes escape outside the cages due to the presence of external electric field.

3. The generator of claim 2, wherein the ionizing electrodes are connected to different polarity of the AC high-voltage generator is carried out by two inversely-connected rectifying diodes.

4. The generator of claim 3, wherein the element for producing a voltage drop is a Zener diode with a condenser.

5. The generator according to claim 2, further provided with a comparator for comparing a feedback signal corresponding to the ion current emitted through at least one cage with a reference signal to control the AC high-voltage generator, for stabilizing ion emission.

6. The generator according to claim 2, further provided with a comparator for comparing a feedback signal corresponding to the ion current emitted through at least one electrode with a reference signal to control the AC high-voltage generator, for stabilizing ion emission.

7. The generator according to claim 2, further provided with an indicator for indicating the need for cleaning the electrodes from dust or repair.

* * * * *